US005156176A

United States Patent [19]

Doorenbos

[11] Patent Number: 5,156,176

[45] Date of Patent: Oct. 20, 1992

[54] STABILIZED WALKER DEVICE

[76] Inventor: Daryl E. Doorenbos, R.R. 2, Box 85A, Le Mars, Iowa 51031

[21] Appl. No.: 669,636

[22] Filed: Mar. 4, 1991

Related U.S. Application Data

[63] Continuation-in-part of Ser. No. 554,477, Jul. 19, 1990.

[51] Int. Cl.[5] ..... A61H 3/00

[52] U.S. Cl. ..... 135/67; 135/82; 135/85; 297/5

[58] Field of Search ..... 135/66, 67, 82, 85; 297/5, 6

[56] References Cited

U.S. PATENT DOCUMENTS

| | | | |
|---|---|---|---|
| 788,541 | 5/1905 | Kunkel | 135/82 X |
| 1,061,397 | 5/1913 | Newell | 135/82 |
| 1,448,783 | 3/1923 | Blewitt et al. | 297/6 |
| 2,657,735 | 11/1953 | Hughes | 135/67 X |
| 2,792,052 | 5/1957 | Johannesen | 135/67 |
| 3,778,052 | 12/1973 | Andow et al. | 135/67 X |
| 3,872,945 | 3/1975 | Hickman et al. | 297/5 X |
| 4,188,962 | 2/1980 | Palmer et al. | 135/67 |
| 4,700,730 | 10/1987 | Samuelson et al. | 297/5 X |
| 4,770,410 | 9/1988 | Brown | 135/67 X |
| 4,773,639 | 9/1988 | Graves | 297/5 X |
| 4,981,307 | 1/1991 | Walsh | 297/5 X |

FOREIGN PATENT DOCUMENTS

| | | | |
|---|---|---|---|
| 236511 | 6/1958 | Australia | 297/5 |
| 671973 | 10/1964 | Italy | 297/5 |

*Primary Examiner*—David A. Scherbel
*Assistant Examiner*—Lan Mai

[57] ABSTRACT

A device for supporting an unstable ambulatory patient while walking. The device is similar to a customary walker except that the user is additionally supported by a harness attaching the user to the walker by a readily releasable latch or snap device, and the legs of the walker are springable to provide both for a broader base of the walker to inhibit tipping and to reduce the jolt to the patient should the patient fall. The walker is designed for independent use by the patient.

10 Claims, 2 Drawing Sheets

STABILIZED WALKER DEVICE

BACKGROUND AND SUMMARY OF THE INVENTION

This invention pertains to devices for supporting people who because of some infirmity have difficulty walking and is a continuation in part of my prior application, Ser. No. 07/554,477, filed Jul. 19, 1990.

The device is particularly useful when the person using it is subject to a prevalent risk of falling.

Persons who are recovering from strokes, fractures and the like and people who may have other infirmities frequently need auxiliary support in order to walk. Such support may be provided by crutches or canes, but frequently the best support is an aluminum frame called a "walker". Walkers are simple frame devices having four legs spaced so that, when in use, the legs provide support at each corner of a rectangle surrounding the user. Thus, a relatively stable frame of support is provided.

The use of a walker, however, still requires the user to support himself or herself on the frame by the arms. If the person falls and hasn't enough strength in his or her arms to catch and break the fall, the walker fails in its purpose. Further, if the base of the walker is so narrow that it tips, the walker also fails.

Other walker devices designed for complete support of the patient require the help of an assistant to fasten the handicapped person into a fully restraining walker. Assistance is also required to help the person out of such a device. Such devices also frequently are not walkers at all, but rather use castors on wheels to allow the patient to roll the device on the floor propelled by some leg motion, but not truly walking. By my invention, I provide protection from falling and full independence for the handicapped person in entering or leaving the walker.

By my invention I also provide an auxiliary attachment to fasten the user to the walker to provide additional support in the event of a fall by a person whose legs and arms are both of failing strength. Further, in order to avoid possible added injury or discomfort, I also provide for a cushioned stop of the fall by providing springable legs which will moderate the jolt of a fall, should that happen. The legs are designed to move against a resilient force but in an outward direction so that the rectangle surrounding the user is enlarged to provide a broader base for the walker and thus to inhibit tipping.

DESCRIPTION

Figure 1:
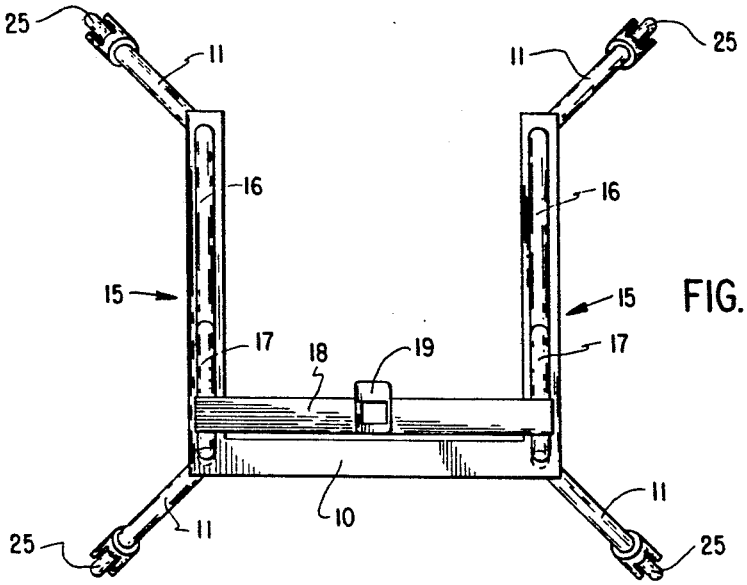
FIG. 1 is a top plan view of the support device of my invention.

Briefly my invention comprises a device to support a person unsteady on his or her legs but not truly disabled. The device will continue to support that person after a fall and will serve to lessen the impact of the fall.

More particularly and referring to the drawings, the embodiment of my invention comprises a device similar to a walker having a framework composed of a base member 10 formed as three sides of a rectangular figure from which four legs 11 extend downwardly. These legs may be additionally supported by a support member 12 extending on the same three-sides as the base 10. One side of the rectangle, which may be designated as the rear side, is left open to surround the body of the user.

Arms 15 extend upwardly from the base 10. These arms are formed with a lower, substantially horizontal arm rest 16 and an elevated strap-holding member 17 also substantially horizontal. A strap 18 extends across the space between the members 17 and carries one part 19 of a separable attachment such as a buckle. The strap 18 and buckle are of material and strength similar to seat belts and shoulder harnesses now in use in vehicles such as aircraft and automobiles. Preferably, the part 19 of the buckle is the female portion because typically, that part is the heavier part.

The male part 20 of the buckle is attached to a harness 21 adapted to be worn by the user. Thus, when the buckle parts are united, the user is firmly attached to the frame of the walker. Enough flexibility is built into the harness so that the walker can be moved in a normal manner. That flexibility can be best provided by variation in the length of the connecting strap 22 on the user's harness 21. That strap is preferably not adjustable for reasons of strength and weight. However, different lengths for different harnesses may be provided so that different patients can be accommodated. Although I have described and illustrated the fastener as a buckle, it will be obvious that other fastening devices having readily disengageable parts might be used.

Figure 2:
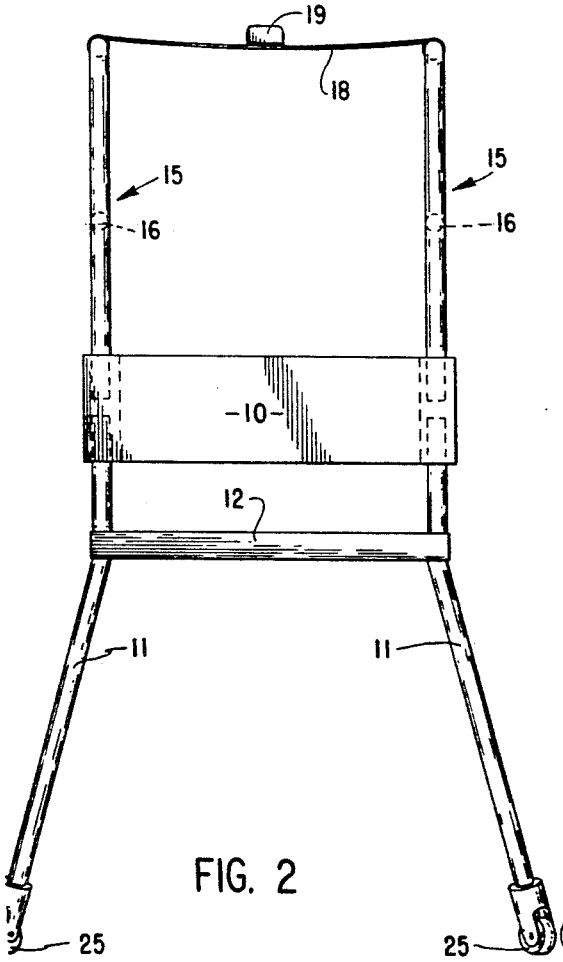
FIG. 2 is a front elevational view of the support device.
Figure 3:
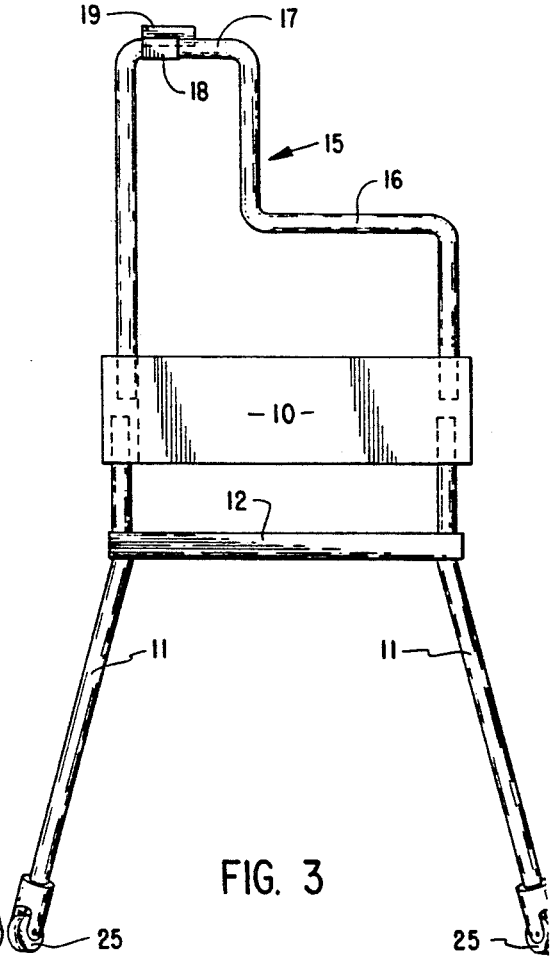
FIG. 3 is a side elevational view of the support device.

Another important feature of my invention is the provision of springable legs. In my preferred embodiment (FIGS. 1-3) the legs 11 spread diagonally outwardly as shown in the figures. Essentially, the direction of the spread is on the line of a diagonal of the rectangle formed by the frame. Wheels 25 are provided at the bottom of the legs 11. These wheels are preferably designed to run only in the direction in which the legs spread. Therefore, they will not normally roll in any linear direction of movement of the walker, but will, in fact, resist such rolling. It might be possible, although not necessarily recommended, to use castoring wheels on the front legs and fixed wheels on the rear. This will make movement easier for some patients who can adequately control the device to raise only the rear wheels and roll it forward on the front wheels. However, my preferred form would provide for wheels directed so as not to allow rolling of the entire device in any particular direction.

The legs 11 are formed of a flexible material so that each forms a springable member adapted to flex upon the application of force such as weight on the frame. Thus, the upper frame is, in effect, springably mounted above the floor.

The function of the device will now be obvious. A user wearing the harness simply fastens the buckle by inserting a male part 20 into the female part 19, thus fastening the user to the walker. Such fastening can readily be accomplished by the patient alone without assistance from a caretaker. In normal user, the walker acts like any other walker, being advanced manually followed by the user walking again into the open part of the walker. Should the user stumble or fall, the usefulness of this new device becomes apparent. When the user falls, the fall is quickly stopped by the harness. However, if the only force to stop the fall was that of the harness, there would be a quick jerk which might be painful or even injurious to the user. Because of the springable legs 11, the entire frame resists the fall, but does not suddenly stop it. Rather the springiness greatly supports the user and prevents injury. The direction of the wheels 25 will now be apparent. Instead of rolling the walker, they simply roll outward from the center to allow the legs to splay outwardly as the spring in the legs acts to support the added weight of the falling user. I prefer to use wheels somewhat braked by friction so that rolling is not free but rather somewhat restricted.

Figure 5:
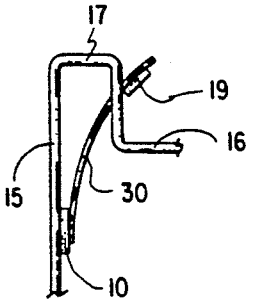
FIG. 5 is a partial side elevational view showing an alternative arrangement of the harness connecting device.
Figure 6:
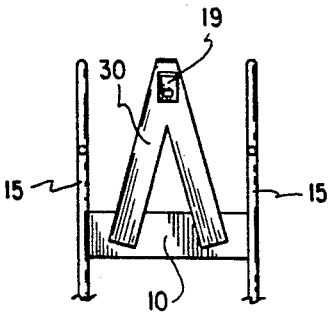
FIG. 6 is a partial rear elevational view of the device shown in FIG. 5.
Figure 4:
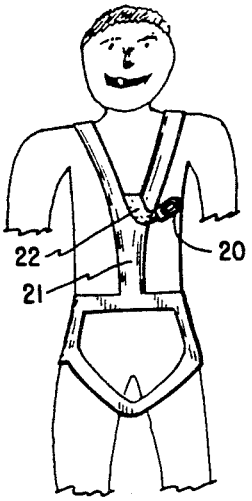
FIG. 4 is a diagrammatic view showing the harness for the support.

In FIGS. 5 and 6 I illustrate an alternative, and less desirable, form of attachment of the harness to the frame. In this device, I mount a springable attaching frame 30 of inverted V-shape on the front base member 10. This attaching frame carries the female part 19 of the buckle to provide attachment for the harness 21 to the walker. This embodiment accomplishes the same purpose as that originally described, but suffers the disadvantage of some minor, potential danger of the user falling onto the attaching frame. Therefore, the originally described embodiment is preferred.

Figure 7:
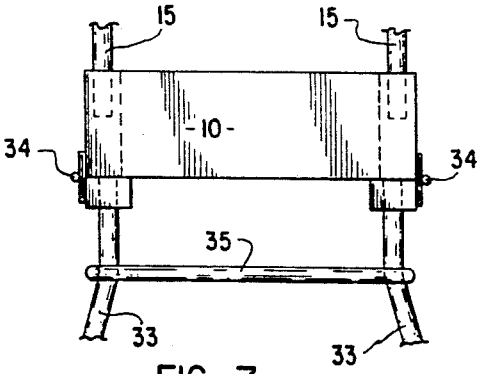
FIG. 7 is a partial front elevational view of a support device having an alternative mode of providing springable legs.
Figure 8:
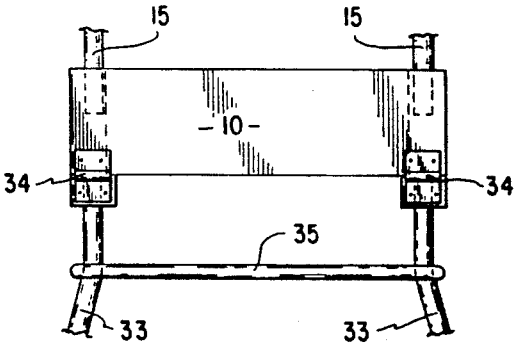
FIG. 8 is a partial side elevational view of the device of FIG. 7.
Figure 9:
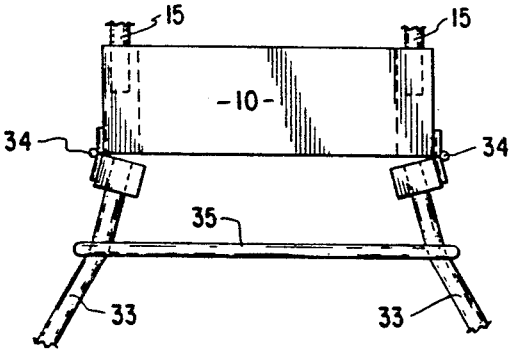
FIG. 9 is a view similar to FIG. 7 showing the legs partially extended.

Alternative means may also be used to provide the springing action of the legs. In FIGS. 7–9 I illustrate the possibility of using rigid legs 33 attached to the base member 10 by means of hinges 34. The springing resistance for a falling user may then by provided by use of a rubber cord 35 extending between the legs 33 on the three sides closed by the member 10. It will be obvious that the hinges could also be oriented so that the legs will spread on the diagonal lines notes in connection with the originally described device. It will also be obvious that individual springs could be used on each leg without departing from the invention.

I also envision, for either embodiment, that either the upper frame or the legs may be adjustable as to height. Because both frame and legs may be made of tubing, such adjustability is well within the normal skill of anyone skilled in the art.

It may be possible to add a signalling device which will sense and signal the failure to fasten the buckle so that the user will be warned to engage the buckle as the device is used.

I claim as my invention:

1. A support device for an unstable person comprising a frame including legs, a support member extending upwardly from said legs to a top member, said support member being adapted to be engaged by said person's arms whereby said person may be supported, harness means adapted to worn by said person, readily releasable attachment means engaged between said top member and said harness means whereby said person can attach and release himself from said support device, the lower end of said legs forming a quadrilateral-shaped base for said device, said legs being resiliently resistive to motion and extending from upper end to lower end in a direction diagonally away from the center of said base, movement of the lower ends of said legs in said diagonal direction thus being effective to broaden said base of the device to resist tipping, said resistive resilience also being capable of resisting any sudden downward force on said device and wheels on the lower ends of said legs, said wheels being permanently aligned in the direction diagonally away from the center of said base to assure movement of said lower ends only in that diagonal direction.

2. The device of claim 1 in which said harness includes a connecting strap, said strap being the part of said harness connected to said attachment means, said strap being of sufficient length that the support device can be successively moved a distance approximately equal to a step of said person.

3. The device of claim 2 in which said support member includes arms on each of two sides, and flexible means extending between said arms provides support for said attachment means.

4. The device of claim 1 in which said legs and said support member are held together by a substantially rectangular base member, one side of said rectangular member being open so that the person is enclosed on three sides.

5. The device of claim 4 in which said readily reseasable attachment means includes snap means resiliently mounted on said base member whereby said support device can be successively moved a distance approximately equal to a step of said person.

6. The device of claim 1 in which said legs are formed of spring-like material and extend from said support member without added support so that said legs provide the resilience.

7. The device of claim 6 in which wheels are mounted on said legs, said wheels being oriented to roll only in a direction toward and away from the center of said base of said device and therefore oblique to the proposed direction of customary motion of said device.

8. The device of claim 7 in which said legs are splayed slopingly outward in the directions in which said wheels are oriented to roll.

9. The device of claim 6 in which wheels are mounted on said legs, said wheels being resistant to rolling by reason of friction.

10. The device of claim 1 in which said legs are movably attached to said support member, and resilient means engages said legs to provide the resilient resistance necessary to restrain the downward force.

* * * * *